United States Patent [19]

Leishman

[11] Patent Number: 5,028,166

[45] Date of Patent: Jul. 2, 1991

[54] HIGHWAY GUIDEPOST

[75] Inventor: Layne S. Leishman, Huntington Beach, Calif.

[73] Assignee: Product Research and Development, Santa Ana, Calif.

[21] Appl. No.: 438,714

[22] Filed: Nov. 17, 1989

Related U.S. Application Data

[63] Continuation-in-part of Ser. No. 424,058, Oct. 19, 1989.

[51] Int. Cl.[5] ..... E01F 9/00

[52] U.S. Cl. ..... 404/10; 405/231; 52/155

[58] Field of Search ..... 173/30; 405/231, 232, 405/244; 404/10, 11; 52/155-163

[56] References Cited

U.S. PATENT DOCUMENTS

| | | | |
|---|---|---|---|
| 1,921,302 | 8/1933 | Polhemus | 52/155 |
| 3,210,897 | 10/1965 | Whittington | 405/244 |
| 3,402,560 | 9/1968 | Alm | 405/231 |
| 3,498,588 | 3/1970 | Turner, Jr. | 52/155 |
| 4,092,081 | 5/1978 | Schmanski | 404/10 |
| 4,522,530 | 6/1985 | Arthur | 52/155 |

*Primary Examiner*—Douglas D. Watts

*Assistant Examiner*—Scott A. Smith

*Attorney, Agent, or Firm*—Gordon L. Peterson; Loyal M. Hanson

[57] ABSTRACT

A guidepost includes an elongated post member and an anchor member, the post member having first and second ends and a tip portion extending to the second end that narrows in at least one dimension in order to facilitate penetration into the ground. The post member defines an opening adjacent the second end, the anchor member has at least a first leg, and the anchor member extends through the opening in the post member to a position such that the first leg of the anchor member extends outwardly from the opening and away from the second end. According to another aspect of the invention, the post member includes first and second sides facing in generally opposite directions and a runner arrangement defining at least one longitudinally extending rib for abutting a sleeve placed over the post member for post driving purposes in order to limit the amount of post member surface area contacting the sleeve and thereby to facilitate sliding of the post member through the sleeve. For that purpose, the post member may include a gullwing-shaped cross section.

12 Claims, 3 Drawing Sheets

16
18
11
24
13
17
20
14
23
12
26
27

HIGHWAY GUIDEPOST

CROSS REFERENCE TO RELATED APPLICATION

This application is a continuation in part of copending U.S. patent application Ser. No. 424,058 filed Oct. 19, 1989 (the parent application).

BACKGROUND OF THE INVENTION

1. Technical Field

The invention relates generally to posts, and more particularly to a flexible post of the type used along highways.

2. Background Information

A flexible post of the type used along highways is sometimes called a flexible, highway-delineator guidepost or just guidepost. It may be used to mark such things as the highway edge, the shoulder, or an object or feature of the terrain along the highway. In addition, it may be fabricated and installed according to governmental specifications.

In that regard, typical guidepost specifications such as those issued by CAL-TRANS of the State of California may require that the guidepost be about five and one-half feet long so that eighteen inches can be driven into the ground with the other four feet remaining above ground. The guidepost specifications may also require that the guidepost be installable by driving it into the ground without the need for a separately prepared pilot hole (i.e., a separate hole-forming tool and hole-forming operation) and that when installed the guidepost be capable of enduring ten hits by an automobile traveling at fifty-five miles-per-hour without failing to come back to within twenty degrees of a vertical position.

Among other things, such specifications mean that the guidepost must remain well anchored in the ground. Accomplishing that along with the required flexibility and driveability has been somewhat difficult to do. Consequently, it is desirable have a highway guidepost that satisfies typical guidepost specifications of the type mentioned while being reasonably economical to fabricate.

SUMMARY OF THE INVENTION

This invention solves the problems outlined above by providing a guidepost having an elongated post member to which a separate anchor member is attached. That arrangement facilitates fabrication of the post member to satisfy specifications of the type previously mentioned, preferably by extruding a thermoplastic material in order to form a generally flat, elongated post member, and it also enables convenient attachment of the separate anchor member, preferably a V-shaped strip of stiff steel inserted through an opening formed in the lower end portion of the post member. Specifications are met and the resulting guidepost remains more securely anchored once it is driven into the ground.

Generally, a guidepost constructed according to the invention includes an elongated post member and a separate anchor member mounted on the post member. The post member extends between first and second ends of the post member and the post member has a tip portion that extends to the second end, the member narrowing in at least one dimension towards the second end in order to facilitate penetration of the tip portion into the ground. In addition, the post member defines an opening adjacent the second end of the post member, the anchor member has at least a first leg, and the anchor member extends through the opening in the post member to a position such that the first leg of the anchor member extends outwardly from the opening and away from the second end.

In one embodiment, the post member includes first and second sides facing in generally opposite directions, the anchor member includes two legs, and the anchor member extends through the opening in the post member to a position such that the first leg of the anchor member extends outwardly from the opening away from the first side and the second leg extends outwardly from the opening away from the second side. The opening may extend transversely to a longitudinal axis of the post member, each of the first and second legs may extend away from the second end of the post member at an angle between the leg and the post member of from about fifteen degrees to about sixty degrees (preferably about forty-five degrees), and the anchor member may include a strip of material having a V-shaped configuration, preferably a strip of steel alloy material bent into the V-shaped configuration. In addition, the anchor member may be mounted within the opening so that the anchor member can pivot sufficiently to enable adjustment of leg position.

According to another aspect of the invention, there is provided a guidepost having a runner arrangement for abutting a sleeve placed over the post member for post driving purposes. The runner arrangement reduces the amount of post member surface area contacting the sleeve in order to facilitate the sliding of the post member through the sleeve.

Generally, such a guidepost includes an elongated post member extending between first and second ends of the post member, the post member having a tip portion extending to the second end, which tip member narrows in at least one dimension towards the second end in order to facilitate penetration of the tip portion into the ground. In addition, the post member has first and second sides facing in generally opposite directions and runner means defining at least one longitudinally extending rib on one of the first and second sides of the post member for abutting a sleeve placed over the post member for post driving purposes in order to reduce the amount of post member surface area contacting the sleeve and thereby to facilitate sliding of the post member through the sleeve. For that purpose, the runner means may include at least one of the first and second sides of the post member having at least one and preferably two longitudinally extending ribs.

According to still another aspect of the invention, there is provided a guidepost having a cross sectional shape configured to facilitate sliding of the post member through the sleeve. The guidepost includes a post member having what may be called a gullwing-shaped cross section that includes a central portion and first and second wing portions, each of the first and second wing portions extending to a respective one of the first and second marginal edges that abut the sleeve.

The foregoing and other objects and features of the invention and the manner of attaining them will become apparent and the invention itself will be best understood by reference to the following description taken in conjunction with the accompanying illustrative drawings.

DESCRIPTION OF THE PREFERRED EMBODIMENTS

Figures 1, 2:
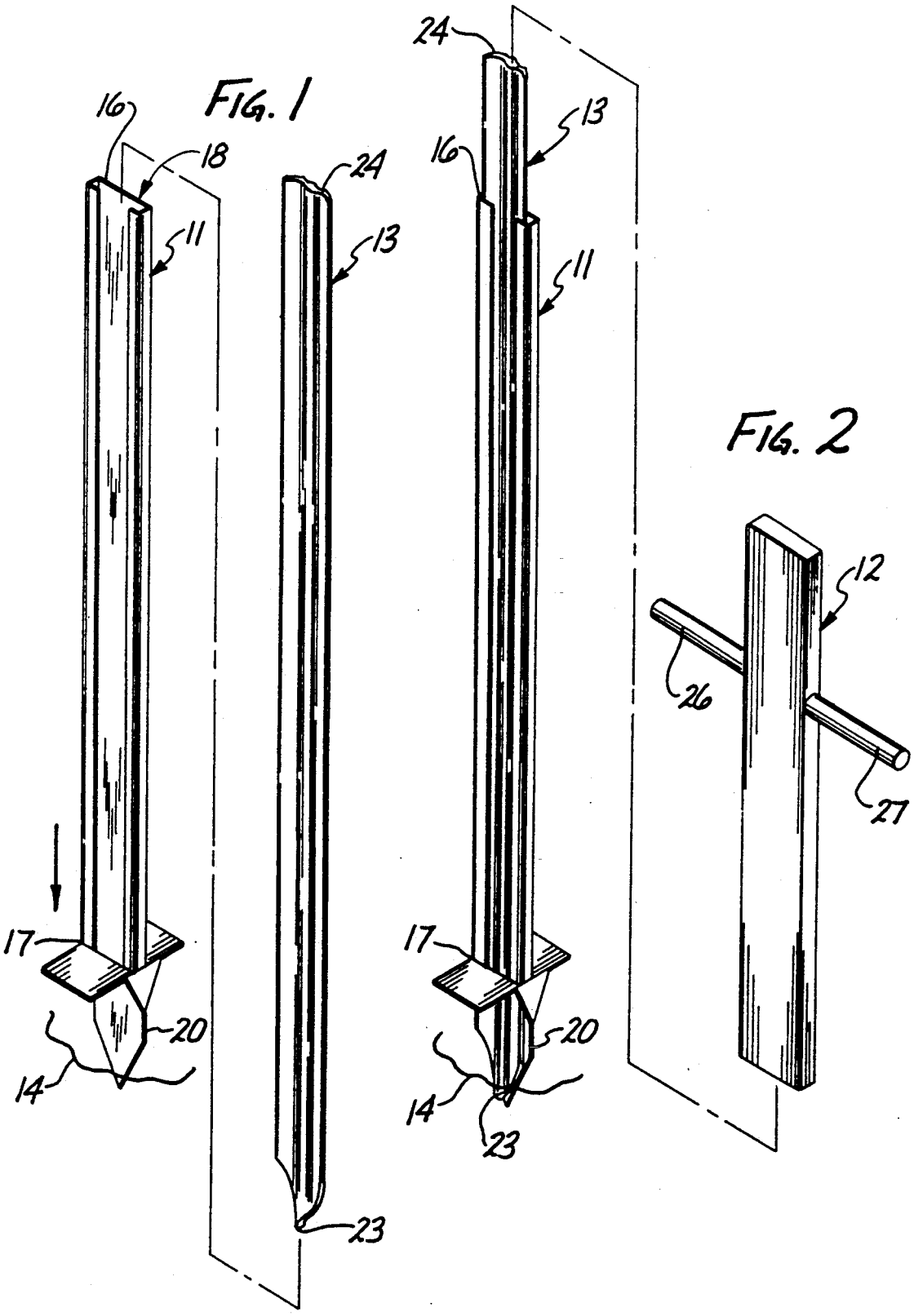
FIG. 1 of the drawings is a perspective view showing placement of a flexible guidepost constructed according to the present invention into the sleeve component of a post driver that is constructed according to the invention described in the parent application.
FIG. 2 is a perspective view showing placement of the driver component over the guidepost and the containment sleeve component.

For convenience, the following description of the preferred embodiments includes details of the post driver and methodology that is the subject of the parent application. The post driver and methodology are described first. Then, there are presented further details of a guidepost constructed according to the invention that is the subject of this continuation in part application.

Post Driver And Methodology

Briefly, the parent application concerns a post driver that includes both a containment sleeve and an overdriver, the containment sleeve functioning to support the post as the post is driven into the ground with the driver. Properly configured, the containment sleeve (or just sleeve) and the overdriver (or just driver) provide support to substantially the full length of the post above ground. Thus, the post driver helps prevent buckling and bending. It also helps keep the post from becoming stuck in the driver. It involves easily operated components that work without a separately formed pilot hole, and it can provide automatic height control as subsequently discussed.

Generally, an apparatus for driving a post into the ground that is constructed according to a major aspect of the invention that is the subject of the parent application includes means defining a sleeve for supporting a post as the post is driven into the ground and means defining a driver for driving the post into the ground while the post is supported by the sleeve. The sleeve defines a channel that is dimensioned and arranged to receive the post so that the post can slide through the channel as the post is driven into the ground and the driver is dimensioned and arranged to slide over the sleeve in order to drive the post through the channel into the ground.

According to another aspect of the invention that is the subject of the parent application, the sleeve may have a length sufficient to extend from the ground to a height to which the post is to be driven. That provides the automatic height control mentioned previously, the installer simply driving the post until the upper end of the post is even with the upper end of the sleeve. According to still aspect, the sleeve can include spade means attached to a lower end portion of the sleeve for enabling a user to break the ground into which the post is to be driven. In that regard, the spade means may include a blade member and at least one step member configured for a user to step upon in order to force the blade member into the ground.

According to yet another aspect of the invention that is the subject of the parent application, the driver includes means for supporting an upper portion of the post as the post is driven into the ground. That is desirable because initially the upper end of the post extends out of the upper end portion of the sleeve so that it is not supported by the sleeve. Preferably, the driver includes an inwardly extending rib to provide the support, the rib extending toward the post so that it can bear against the upper end portion of the post to provided needed support. In that regard, the sleeve may have a C-shaped cross section so that the rib can extend into the channel when the driver is placed telescopingly over the sleeve.

In line with the above, a method of driving a post into the ground according to the invention that is the subject of the parent application includes the step of providing a sleeve for supporting the post as the post is driven into the ground and a driver for driving the post into the ground while the post is supported by the sleeve. The method proceeds by placing the post within the sleeve, placing the driver over the post and the sleeve, and placing the post and the sleeve in generally vertical position at a location on the ground where the post is to be driven. Then, the installer operates the driver to drive the post into the ground.

The method may include other steps that reflect the inventive concepts mentioned previously. For example, the sleeve may include spade means attached to a lower end portion of the sleeve for enabling a user to break the ground into which the post is to be driven, and the step of placing the post and the sleeve at a location where the post is to be driven may include the step of breaking the ground with the spade means. In addition, the spade means may include a blade member and at least one step member configured for a user to step upon in order to force the blade portion into the ground, and the step of breaking the ground with the spade means may include placing the blade member at the location where the post is to be driven and stepping upon the step member in order to make a hole in the ground with the blade member.

Furthermore, the spade means may include a blade member and two oppositely disposed step members configured for an installer to step upon in order to force the blade portion into the ground. In that case, the step of breaking the ground with the spade means may include placing the blade member at the location where the post is to be driven, stepping upon the step members in order to make a hole in the ground with the blade member, and swaying the sleeve slightly as the blade member makes a hole in the ground in order to enlarge the hole. The driver is operated somewhat conventionally, the installer moving the driver upwardly relative to the sleeve and the post and then slamming the driver downwardly so that the driver impacts an upper end of the post to thereby drive the post into the ground. Moreover, the method may proceed with a sleeve that has a length sufficient to extend from the ground to a height to which the post is to be driven and the step of operating the driver may include driving the post into the ground until an upper end of the post is substantially even with an upper end of the sleeve.

Driver operation proceeds somewhat conventionally, the installer moving the driver upwardly relative to the sleeve and the post and then slamming the driver downwardly so that the driver impacts an upper end of the post to thereby drive the post into the ground. But the method may include the step of supporting the upper portion of the post during the driving step as described previously.

Figure 3:
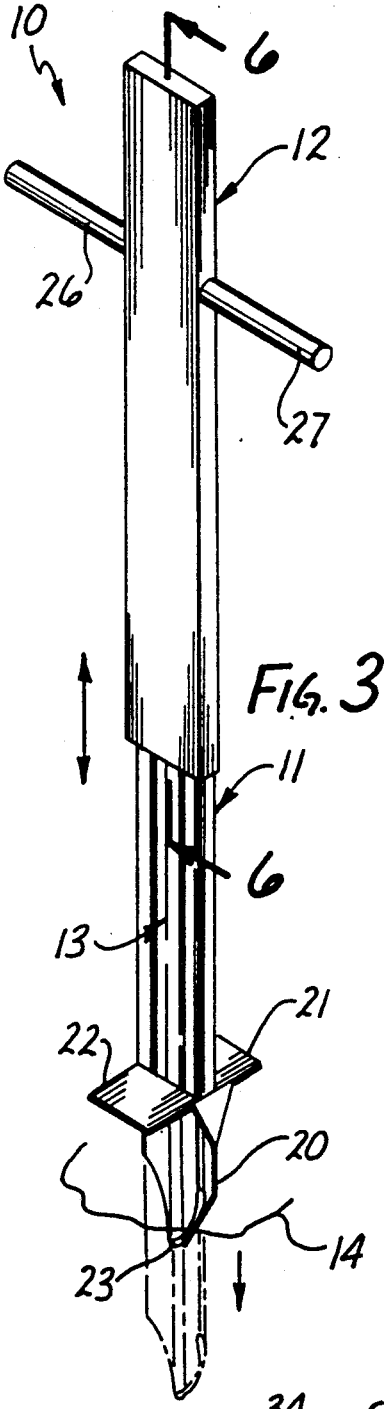
FIG. 3 is a perspective view illustrating operation of the post driver.
Figure 6:
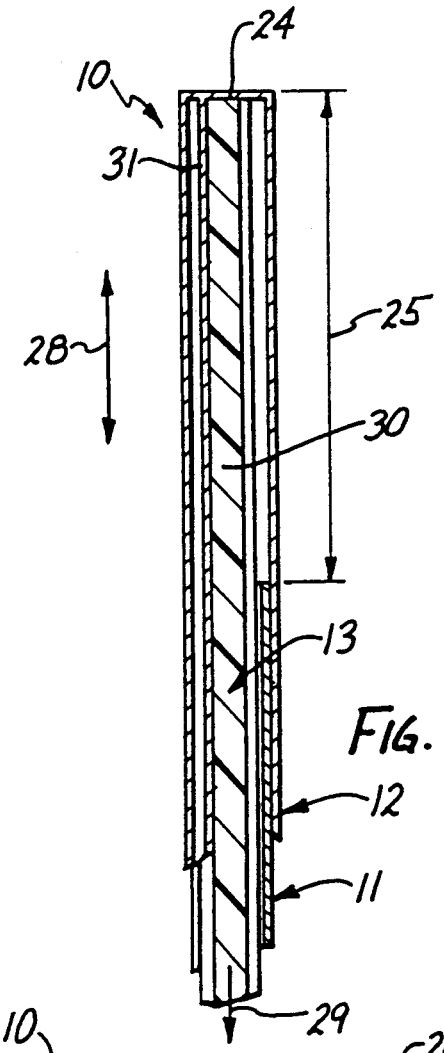
FIG. 6 is a cross sectional view of the post driver and the guidepost taken on line 6—6 of FIG. 3.
Figure 5:
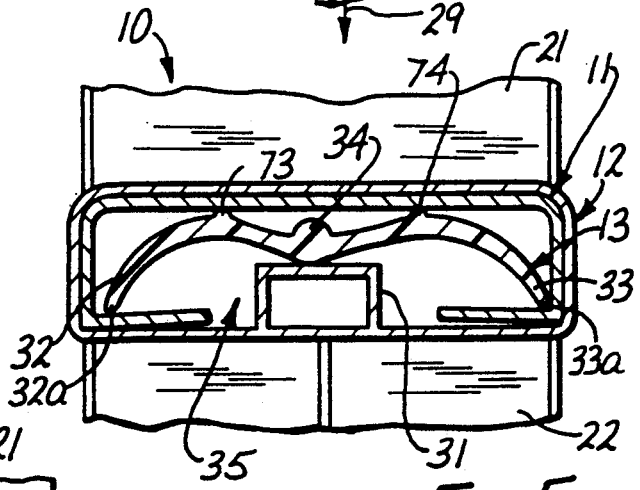
FIG. 5 is an enlarged cross sectional view similar to FIG. 4 except that the driver component is included.

Referring now to the drawings, there is shown the various steps of a method of driving a post into the ground (FIGS. 1–6) utilizing a post driver 10 (shown assembled in FIGS. 3, 5, and 6). The post driver 10 includes a sleeve member or sleeve 11 (FIGS. 1–6) and a driver member or driver 12 (FIGS. 2, 3, 5, and 6) that assemble together with a post 13 (FIGS. 1–6) that is to be driven into the ground 14 (FIGS. 1–3).

The post 13 is a flexible guidepost of the type that might be used along the highway. For that purpose, it may be extruded from a suitable thermoplastic material so that it has the illustrated gull-wing cross section (FIGS. 4 and 5), measures about five and one-half feet long by nearly four inches wide, and exhibits the physical properties required by such flexible guidepost specifications as those issue by CAL-TRAN of the State of California. Of course, the invention is not limited to use with such a guidepost.

In that regard, the term "post" is intended to mean any of various elongated objects that can be fixed in a somewhat vertical position, including, without limitation, any of various posts, poles, or stakes that can be installed by driving it into the ground to mark or indicate something. In addition, "driving a post into the ground" and "to be driven into the ground" means partially into the ground, the term "ground" including earth, soil, and any other substance that a post might be driven into.

Considering the sleeve 11 in further detail, it has a first or upper end 16, a second or lower end 17, and a length between the upper and lower ends 16 and 17 sufficient to extend from the ground 14 substantially to a height to which the post 13 is to be driven (FIGS. 1 and 2). In other words, the sleeve 11 is as long as the above-ground or exposed portion of the post 13 is to be once the post 13 is fully installed (i.e., driven into the ground 14).

The sleeve 11 is an elongated member composed of a suitably strong, rigid material, such as a steel alloy. It defines a channel 18 extending between the upper and lower ends 16 and 17, the channel 18 being dimensioned and arranged to receive the post 13 so that the post 13 can slide through the channel 18 and there be supported by the sleeve 11 as the post 13 is driven into the ground 14. For that purpose, the sleeve 11 has the illustrated C-shaped cross section (FIGS. 4 and 5) that results in the channel 18 measuring nearly four inches wide by about three-fourths inch deep, that configuration suitably accommodating the size and shape of the post 13. Of course, those dimensions are not critical within the broader inventive concepts disclosed.

According to another aspect of the invention, the sleeve 11 includes spade means attached to the lower end 17 of the sleeve 11 for enabling a user to break the ground 14 into which the post 13 is to be driven. Preferably, the spade means includes a blade member 20 (FIGS. 1—3) that acts as a spade, the blade member 20 being composed of a suitably strong, rigid material such as steel and suitably attached to the sleeve 11, either integrally in one-piece construction or as a separate attached part. In addition, the spade means includes at least one and preferably two step members 21 and 22 that are configured for a user to step upon in order to force the blade member 20 into the ground 14 (FIGS. 1—5).

The post 13 may first be inserted into the channel 18, feeding a lower end 23 of the post 13 into the channel 18 at the upper end 16 of the sleeve 11 (FIG. 1). Then, with the sleeve 11 held generally vertically at a location where the post 13 is to be driven into the ground 14, as shown in FIG. 3, the user steps on one or both of the step members 21 and 22. While that is done, the user may sway the sleeve 11 slightly from side to side. That helps the spade member 20 break the ground 14 and form a hole as the spade member 20 moves to the position illustrated in phantom lines in FIG. 3. It also helps enlarge the hole slightly in order to facilitate movement of the post 13 into the ground 14 so that the lower end 23 of the post 13 extends into the ground 14 about as far as the blade member 20 does as illustrated in FIG. 2.

That leaves an upper end 24 of the post 13 exposed or extending beyond the upper end 16 of the sleeve 11 as shown in FIGS. 2 and 6, the distance between the upper end 24 of the post 13 and the upper end 16 of the sleeve 11 depicted by the arrow 25 in FIG. 6 being the distance the post 13 must yet be driven into the ground 14. The post 13 is driven that additional distance by placing the driver 12 over the upper end 24 of the post 13 so that the driver rests upon the upper end 24 and extends downwardly over the sleeve 11. Then, grasping handles 26 and 27 on the driver 12 (FIGS. 2 and 3), the user moves the driver 12 upwardly and slams it downwardly as depicted by an arrow 28 in FIG. 6, the impact of the driver 12 on the upper end 24 of the post 13 causing the post 13 to move in the direction of an arrow 29 in FIG. 6 as it is driven into the ground 14. When the upper end 24 of the post 13 is even with the upper end 16 of the sleeve 11, the post 13 is at the predetermined height to which it is to be driven. Then, the driver 12 and the sleeve 11 are removed, leaving the post 13 installed in the ground 14 at just the right height.

Thus, the sleeve 11 contains or supports the post 13 all the way to the ground 14. However, the sleeve 11 does not support an upper portion 30 of the post 13 exposed above the upper end 16 of the sleeve 11 (FIGS. 2 and 6), and support is desirable because the driver 12 is composed of a suitably strong, rigid material such as steel and it is somewhat heavy to facilitate the driving operation. As a result, the impact of the driver 12 on the post 13 tends to cause the upper portion 30 to bend and buckle while the upper portion 30 is above the upper end 16 of the sleeve 11.

So, according to another aspect of the invention, the driver 12 is configured to support the upper portion 30 of the post 13. In other words, the driver 12 includes means for supporting the upper portion 30 of the post 13 (FIG. 6) as the post 13 is driven into the ground 14 with the driver 12. That is accomplished in the illustrated embodiment with an inwardly extending rib 31 attached to the driver 12 (FIGS. 5 and 6), the rib 31 extending toward the upper portion 30 of the post 13 as the post 13 is driven into the ground with the driver 12.

Figure 4:
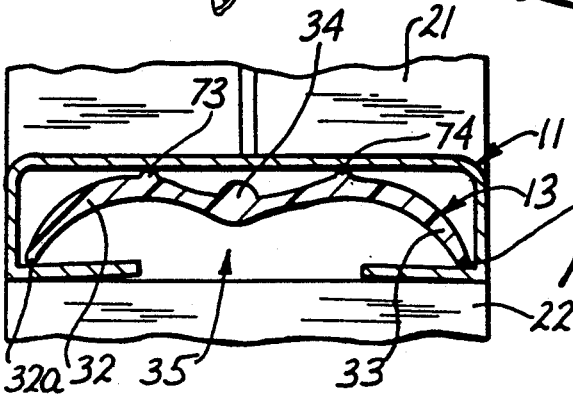
FIG. 4 is an enlarged cross sectional view of the sleeve component taken in a horizontal plane.

More specifically, the post 13 includes a left marginal edge portion or gullwing 32, a right marginal edge portion or gullwing 33, and a central portion or main body 34 (FIGS. 4 and 5). The gullwings 32 and 33 are supported within the channel 18 by the sleeve 11 and above the sleeve 11 by the driver 12, but the main body 34 is unsupported except for the support contributed by the rib 31. However, the rib 31 bears against the main body 34 of the post 13 to provide the needed support, both above the sleeve 11 and through a vertically extending slot 35 that exists in the sleeve 11 by virtue of the C-shaped cross section employed.

The driver 12 is dimensioned and arranged to slide over the sleeve 11 in order to drive the post 13 through the channel 18 into the ground 14. As the driver 12 moves telescopingly downwardly over the sleeve 11, the rib 31 extends through the vertically extending slot 35 in the sleeve 11. Thus, the sleeve 11 and the driver 12 combine to support substantially the full length of the post 13 above the ground 14, and that significantly improves performance in terms of better driving ability coupled with less damage to the post 13.

Thus, the invention that is the subject of the parent application provides a post driver that includes both a containment sleeve and an overdriver. Properly configured, those components provide support to substantially the full length of the post above ground. As a result, the post driver helps prevent buckling and bending. It also helps keep the post from becoming stuck in the driver. It involves easily operated components that work without a separately formed pilot hole, and it can be used to provide automatic height control.

Guidepost

Figure 7:
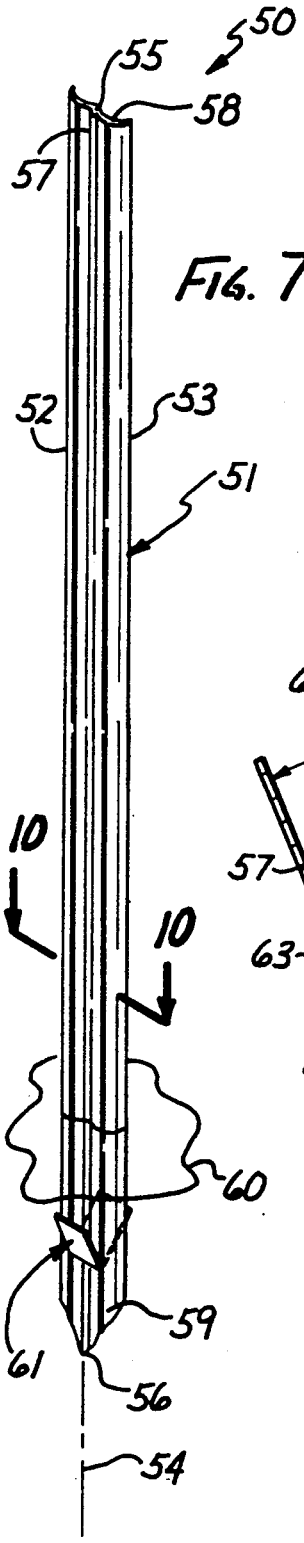
FIG. 7 is a perspective view of another guidepost constructed according to the present invention.
Figure 8:
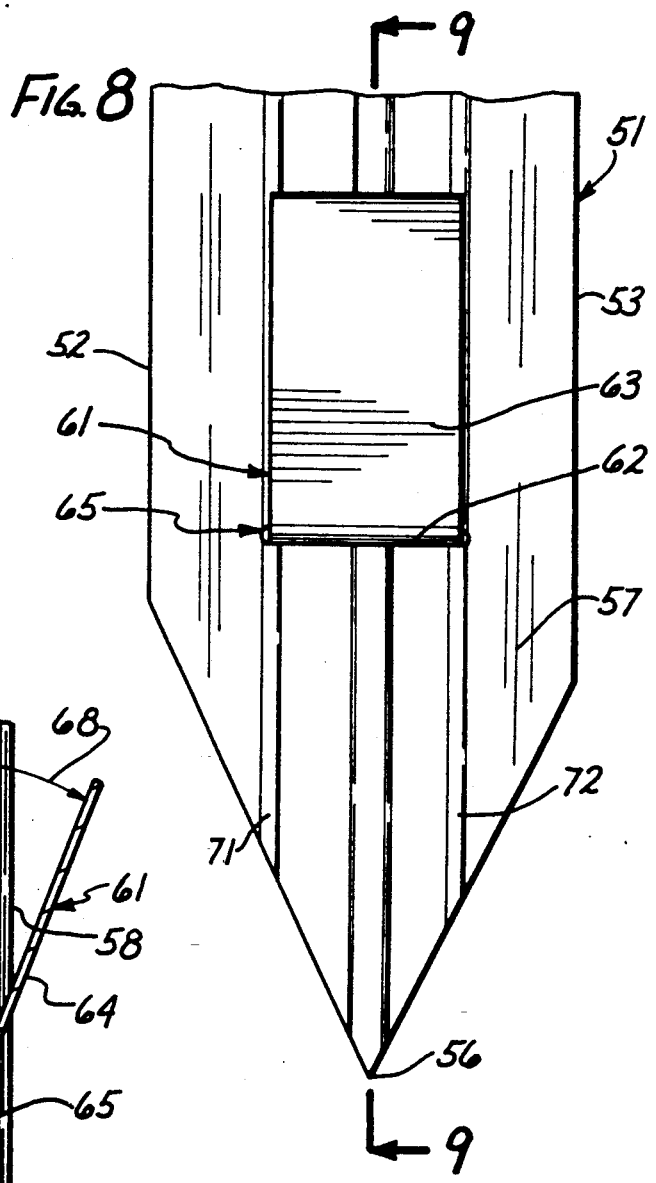
FIG. 8 is an enlarged view of the tip portion of the guidepost illustrated in FIG. 7.

Referring now to FIGS. 7–10, there is shown a guidepost 50 constructed according to the present invention that is similar in many respects to the guidepost 13 in FIGS. 1–6. Generally, the guidepost 50 includes an elongated post member 51 that extends between first and second marginal edges 52 and 53 and along a longitudinal axis 54 from a first end 55 to a second end 56 (FIG. 7). In addition, the post member 51 includes first and second sides 57 and 58 that face in generally opposite directions, and a tip portion 59 that extends to the second end 56, the tip member 57 narrowing in at least one dimension towards the second end 56 in order to facilitate penetration of the tip portion into the ground.

The post member 51 is composed of a material of sufficient flexibility and strength to be driven into the ground 60 (FIG. 7) and meet such highway guidepost specifications as those previously mentioned, preferably an extruded thermoplastic material. As an idea of size, the illustrated post member measures about sixty-six inches long, four inches wide, and three-fourths inch thick. However, those dimensions are not critical within the broader inventive concepts disclosed.

Figure 9:
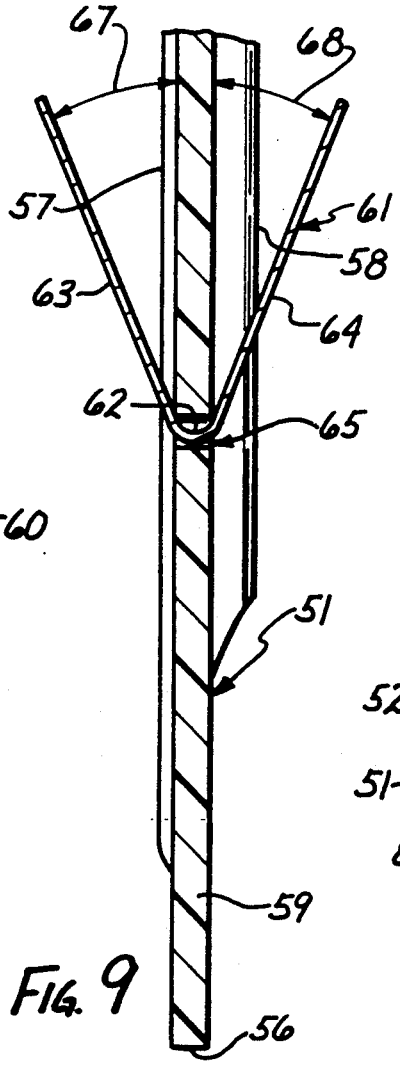
FIG. 9 is a cross sectional view of a portion of the guidepost taken on line 9—9 of FIG. 8.

According to one aspect of the invention, the guidepost 50 includes an anchor member 61 mounted on the post member 51 (FIGS. 7–10). It may take any of various shapes, be formed of any of various resilient materials, and be mounted to the post member 51 in any of various known ways. Preferably, however, the anchor member 61 includes a eight inch strip of 1/16-inch steel about 1-¾inches wide that includes a bend 62 to form four inch long first and second legs 63 and 64, and it extends through an opening 65 in the post member 51 so that the first and second legs 63 and 64 extend outwardly away from the opening 65 and upwardly away from the tip portion 59 as illustrated, forming angles 67 and 68 with the first and second sides 57 and 58 of the post member 51 as illustrated in FIG. 9.

Thus, fabrication is simplified. The opening 65 is formed in the post member 51 by suitable known means such punching, preferably in a position slightly above the tip portion 57 (preferably about one to two inches above) in the full width of the post member 51 so that the post member 51 is not weakened too much by the removal of material for the opening 65. Then the anchor member is inserted through the opening 65 in a force fit sufficient to keep it from falling out until the guidepost 50 is installed. So mounted, the anchor member 61 can pivot or rock sideways within the opening 65 to adjust to the forces experienced as the guidepost 50 is driven into the ground. In other words, the angle 67 can increase as the angle 68 decreases, and vice versa. Also, the anchor member 61 can bend when sufficient force results as the guidepost 50 is driven into the ground. Moreover, the anchor member is still generally disposed toward the second end 56 where it is more effective in gripping the ground (i.e., a lower anchor member 61 generally grips better).

The anchor member 61 is configured so that the sum of the angles 67 and 68 is in the range of about thirty to ninety degrees, preferably about forty-five degrees, less than thirty degrees placing the legs 63 an 64 too close to the post member 51 to be effective and greater than ninety degrees placing the legs 63 and 6 too far from the post member 51 in a position making it difficult to drive the guidepost 50 into the ground. The opening 65 is configured to extend transversely to the longitudinal axis 54.

According to another aspect of the invention, the post member 51 includes runner means for abutting a sleeve placed over the post member for post driving purposes, such as the sleeve 11 described previously in connection with the post driver and methodology that is the subject of the parent application. The post member 51 in FIG. 10 and the guidepost 13 in FIG. 5 are generally similar in that respect, both including longitudinally extending ribs that serve as runner means for abutting a sleeve (such as the sleeve 11 in FIG. 5) in order to limit the amount of post member surface area contacting the sleeve 11, thereby to facilitate the sliding of the post member through the sleeve.

In that regard, "longitudinally extending rib" includes any of various longitudinally extending structures that project from a face of the post member, including a row of two or more spaced-apart lumps or protuberances as well as a continuous rib or ridge. The post member 51 includes first and second ribs 71 and 72 for that purpose (FIG. 10), while the guidepost 13 includes first and second ribs 73 and 74 (FIG. 5). Preferably, the ribs are formed as part of the extrusion process, although they may be attached afterwards, and from the foregoing discussion, it is apparent that ribs could be added to the sleeve to perform a similar function, either in addition to or instead of ribs on the guidepost.

Figure 10:
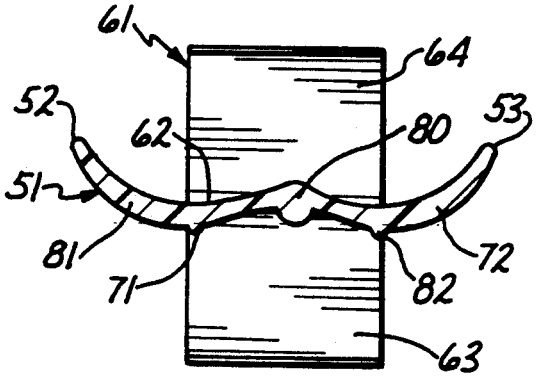
FIG. 10 is an enlarged cross sectional view of the guidepost taken on line 4—4 of FIG. 7.

According to still another aspect of the invention, the post member 51 has a cross sectional shape configured to facilitate sliding of the post member 51 through the sleeve 11. The post member 51 (FIG. 10) and the guidepost 13 (FIG. 5) are similar in that respect also, both having what may be called a gullwing-shaped cross section because the cross sectional shape looks something like the silhouette of a gull or other bird in flight. However, that term is intended to mean only that the cross sectional shape has a central body portion from which first and second wing portions extend along inclined or curved paths to the first and second marginal edges of the post member, as illustrated in FIGS. 5 and 10, preferably along curved paths to avoid the stress concentrations in the post member 51 that can otherwise occur, and preferably along paths disposed generally symmetrical about a line through the central portion.

Thus, the post member 51 has a central portion 80 from which first and second wing portions 81 and 82 extend along curved paths to the first and second marginal edges 52 and 53 (FIG. 10), while the guidepost 13 has a central portion 34 from which first and second wing portions 32 and 33 extend to marginal edges 32*a* and 33*a* (FIG. 5). As shown in FIG. 5 for the guidepost 13, that configuration limits the amount of post member surface area that contacts the sleeve 11 when the sleeve 11 is placed over the post member for post driving purposes. The gullwing-shaped cross section does the same thing for the post member 51.

For the guidepost 13, contact occurs between the first and second marginal edges 32*a* and 33*a* of the guidepost 13 and the sleeve 11 as well as between the longitudinally extending ribs 73 and 74 of the guidepost 13 and the sleeve 11. But that is substantially less than the contact that might occur between, for example, a post member having a cross sectional shape that conforms to the cross sectional shape of the interior of the sleeve 11.

As a result, the gullwing-shaped cross section facilitates the sliding of the post member through the sleeve 11 so that the post member is less prone to bind within the sleeve 11. However, the post member is still braced sufficiently against buckling by the longitudinally extending ribs 73 and 74 and the first and second marginal edges 32*a* and 33*a* abutting the sleeve 11 while the rib 31 abuts the central portion 34 of the guidepost 13.

Thus, the present invention provides various new guidepost features, including a separate anchor member, a runner arrangement, and a gullwing-shaped cross section. Those things facilitate fabrication, help satisfy specifications of the type previously mentioned, and improve operation with a post driver of the type described.

Although an exemplary embodiment of the invention has been shown and described, many changes, modifications, and substitutions may be made by one having ordinary skill in the art without necessarily departing from the spirit and scope of the invention.

What is claimed is:

1. A guidepost comprising:

an elongated post member of a plastic material having an elongated central portion and first and second elongated wing portions extending from the central portion and terminating in first and second elongated marginal edges, respectively;

said post member having a tip portion adapted to facilitate penetration of the tip portion into the ground;

said post member having an elongated opening adjacent the tip portion which extends generally transverse to the direction of elongation of the post member; and a strap-like anchor member extending through said opening and having first and second legs on opposite ends of the post member which define a generally V-shaped configuration, said first and second legs being joined together substantially at said opening in said post member.

2. A guidepost as recited in claim 1 wherein the V-shaped configuration opens away from the tip portion.

3. A guidepost as recited in claim 1 wherein the post member is of extruded construction.

4. A guidepost as recited in claim 1 wherein the anchor member is mounted within the opening so that the anchor member can pivot sufficiently to enable adjustment of the position of the first and second legs.

5. A guidepost as recited in claim 1 wherein the anchor member includes a strip of steel alloy material bent into the V-shaped configuration.

6. A guidepost as recited in claim 1, wherein the post member includes:

first and second sides facing in generally opposite directions; and runner means defining at least one longitudinally extending rib on at least one of the first and second sides of the post member for abutting a sleeve placed over the post member for post driving purposes in order limit the amount of post member surface area contacting the sleeve and thereby to facilitate sliding of the post member through the sleeve.

7. A guidepost as recited in claim 6, wherein the runner means includes at least one of the first and second sides of the post member having two longitudinally extending ribs.

8. A guidepost comprising:

an elongated extruded post member of a plastic material having an elongated central portion and first and second elongated gullwing portions extending from the central portion and terminating in first and second elongated marginal edges, respectively;

said central portion being thicker in cross section than adjacent zones of the gullwing portions;

said marginal edges, as viewed in cross section, being on one side of the central portion and a region of each of said gullwing portions, as viewed in said cross section, being on an opposite side of the central portion than said marginal edges; and said post member having a tip portion adapted to facilitate penetration of the tip portion into the ground.

9. A guidepost as recited in claim 8 including first and second ribs on the first and second gullwing portions adjacent said regions of the associated gullwing portion.

10. A guidepost as recited in claim 9 wherein each of the gullwing portions curves from the central portion toward said region thereof and curves from said region to the marginal edge thereof.

11. A guidepost as recited in claim 8 wherein the post member has an opening adjacent the tip portion which extends generally transverse to the direction of elongation of the post member.

12. A guidepost as recited in claim 8, further comprising:

a separate anchor member mounted on the post member.

* * * * *

UNITED STATES PATENT AND TRADEMARK OFFICE

CERTIFICATE OF CORRECTION

PATENT NO. : 5,028,166

DATED : July 2, 1991

INVENTOR(S) : Layne S. Leishman

It is certified that error appears in the above-identified patent and that said Letters Patent is hereby corrected as shown below:

Column 8, line 28 change "6" to -- 64 --.

Signed and Sealed this

Eighteenth Day of May, 1993

Michael K. Kirk

MICHAEL K. KIRK

*Acting Commissioner of Patents and Trademarks*

*Attest:*

*Attesting Officer*